US009665026B2

(12) United States Patent
Iwasaki et al.

(10) Patent No.: US 9,665,026 B2
(45) Date of Patent: May 30, 2017

(54) TONER AND TWO-COMPONENT DEVELOPER

(71) Applicant: CANON KABUSHIKI KAISHA, Tokyo (JP)

(72) Inventors: Yosuke Iwasaki, Abiko (JP); Nozomu Komatsu, Toride (JP); Takakuni Kobori, Toride (JP); Kohji Takenaka, Toride (JP); Hideki Kaneko, Yokohama (JP); Takeshi Hashimoto, Moriya (JP); Ichiro Kanno, Abiko (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/220,594

(22) Filed: Jul. 27, 2016

(65) Prior Publication Data

US 2016/0334728 A1 Nov. 17, 2016

Related U.S. Application Data

(62) Division of application No. 14/483,975, filed on Sep. 11, 2014.

(30) Foreign Application Priority Data

Sep. 20, 2013 (JP) ..... 2013-195028

(51) Int. Cl.
*G03G 9/097* (2006.01)
*G03G 9/083* (2006.01)
(Continued)

(52) U.S. Cl.
CPC ..... *G03G 9/09725* (2013.01); *G03G 9/0831* (2013.01); *G03G 9/0837* (2013.01);
(Continued)

(58) Field of Classification Search
CPC ..... G03G 9/09708; G03G 9/09716; G03G 9/09725
See application file for complete search history.

(56) References Cited

U.S. PATENT DOCUMENTS 7,135,263 B2 11/2006 Kawakami et al.
9,097,997 B2 * 8/2015 Nomura ..... G03G 9/083
(Continued)

FOREIGN PATENT DOCUMENTS

EP 2 192 448 6/2010
EP 2 192 448 A1 6/2010
(Continued)

OTHER PUBLICATIONS

European Search Report dated Mar. 2, 2015 in European Application No. 14185292.1.

*Primary Examiner* — Hoa V Le
(74) *Attorney, Agent, or Firm* — Fitzpatrick, Cella, Harper & Scinto

(57) ABSTRACT

Provided are a toner and a two-component developer each of which: shows a small fluctuation in charge quantity and a small fluctuation in image density even under a high-temperature and high-humidity environment; and does not cause any member contamination even after endurance and hence can stably output an image. The toner and the two-component developer each have a feature in that positively chargeable strontium titanate fine particles are added to toner particles having fixed thereto negatively chargeable silica fine particles.

6 Claims, 2 Drawing Sheets

(51) Int. Cl.
*G03G 9/113* (2006.01)
*G03G 9/107* (2006.01)

(52) U.S. Cl.
CPC ..... *G03G 9/09708* (2013.01); *G03G 9/09716* (2013.01); *G03G 9/107* (2013.01); *G03G 9/1131* (2013.01); *G03G 9/1133* (2013.01)

(56) References Cited

U.S. PATENT DOCUMENTS

| | | | |
|---|---|---|---|
| 9,164,410 | B2 * | 10/2015 | Kmiecik-Lawrynowicz .... G03G 9/08782 |
| 2010/0310978 | A1 | 12/2010 | Endo et al. |
| 2012/0308923 | A1 | 12/2012 | Loffus et al. |
| 2013/0244159 | A1 | 9/2013 | Ishigami et al. |
| 2013/0244164 | A1 | 9/2013 | Fujikawa et al. |
| 2013/0288173 | A1 | 10/2013 | Hashimoto et al. |
| 2014/0329176 | A1 | 11/2014 | Kanno et al. |

FOREIGN PATENT DOCUMENTS

| | | | |
|---|---|---|---|
| JP | 4944980 | B2 | 6/2012 |
| JP | 2012-133338 | A | 7/2012 |
| WO | 2013/115413 | A1 | 8/2013 |

* cited by examiner

TONER AND TWO-COMPONENT DEVELOPER

This application is a division of application Ser. No. 14/483,975 filed Sep. 11, 2014.

BACKGROUND OF THE INVENTION

Field of the Invention

The present invention relates to a toner and two-component developer to be used in an electrophotographic system, an electrostatic recording system, an electrostatic printing system, or a toner jet system.

Description of the Related Art

In association with the widespread use of a copying machine and a printer, performance required for toner has become more and more sophisticated, and hence additionally high image quality and additionally high endurance stability have been required. Further, the copying machine and the printer that have heretofore been used mainly in an office have started to be used in a severe environment such as a high-temperature and high-humidity environment. It has become important to provide stable image quality even in such case.

The density of a toner for a copying machine and printer to be used in two-component development on a photosensitive member may vary owing to a change in charge quantity of the toner due to its friction with a carrier. In that case, a detrimental effect on its density stability or the like occurs. Particularly under a high-temperature and high-humidity environment, the charge quantity is liable to reduce owing to the friction with the carrier and a reduction in charge quantity of the toner due to its endurance is liable to be a problem. In order that image quality may be maintained even in use under the high-temperature and high-humidity environment, a toner whose triboelectric charge quantity does not change even after its endurance, i.e., a toner having high environmental stability and high endurance stability has been required.

In order that the toner having high environmental stability and high endurance stability may be achieved, studies have been made on the kind of an external additive and the control of the presence state of an external additive for increasing the triboelectric charge quantity of the toner on a toner surface.

Japanese Patent Application Laid-Open No. 2012-133338 proposes an approach involving fixing an inorganic fine particle to the surface of a toner particle through toner surface treatment with hot air. An improvement in stability of a charge quantity against friction with a magnetic carrier has been achieved by suppressing the desorption of the inorganic fine particle.

Japanese Patent No. 4944980 proposes a toner obtained by adding inorganic fine powder having a specific perovskite crystal. The toner has achieved an improvement in image quality by alleviating image deletion at the time of image formation under a high temperature and a high humidity, but has not sufficiently suppressed a fluctuation in image density due to a reduction in charge quantity.

When the toner described in Japanese Patent Application Laid-Open No. 2012-133338 or Japanese Patent No. 4944980 is used in a copying machine or a printer under a severe environment such as a high-temperature and high-humidity environment, the toner has been unable to satisfy the required performance. It cannot be said that its charging stability and density stability are sufficiently satisfactory, and hence an additional improvement has been required.

SUMMARY OF THE INVENTION

The present invention is directed to providing a toner and a two-component developer each of which: has solved the problems; shows a small fluctuation in charge quantity and a small fluctuation in image density even under a high-temperature and high-humidity environment; and does not cause any member contamination even after the formation of a large number of images and hence can stably output an image.

The problems can be solved by a toner and a two-component developer having the following constructions.

That is, the invention according to the present application relates to the following toner and a two-component developer including the toner.

According to one aspect of the present invention, there is provided a toner includes: toner particles each containing a binder resin, a wax, and a coloring agent; and silica fine particles A and strontium titanate fine particles B present on surfaces of the toner particles, in which: the silica fine particles A have a number-average particle diameter (D1) of 60 nm or more and 300 nm or less; when a coverage rate of the surfaces of the toner particles with the silica fine particles A is defined as a coverage rate X (%) and a coverage rate with the silica fine particles A fixed to the surfaces of the toner particles is defined as a coverage rate Y (%), the coverage rate X is 20% or more and 95% or less, and a ratio [coverage rate Y/coverage rate X] of the coverage rate Y to the coverage rate X is 0.75 or more; the silica fine particles A are negatively chargeable; and the strontium titanate fine particles B are positively chargeable.

It is possible to provide the toner and the two-component developer each of which: shows a small fluctuation in charge quantity and a small fluctuation in image density even under a high-temperature and high-humidity environment; and does not cause any member contamination even after the formation of a large number of images and hence can stably output an image.

Further features of the present invention will become apparent from the following description of exemplary embodiments with reference to the attached drawings.

DESCRIPTION OF THE EMBODIMENTS

Figure 1:
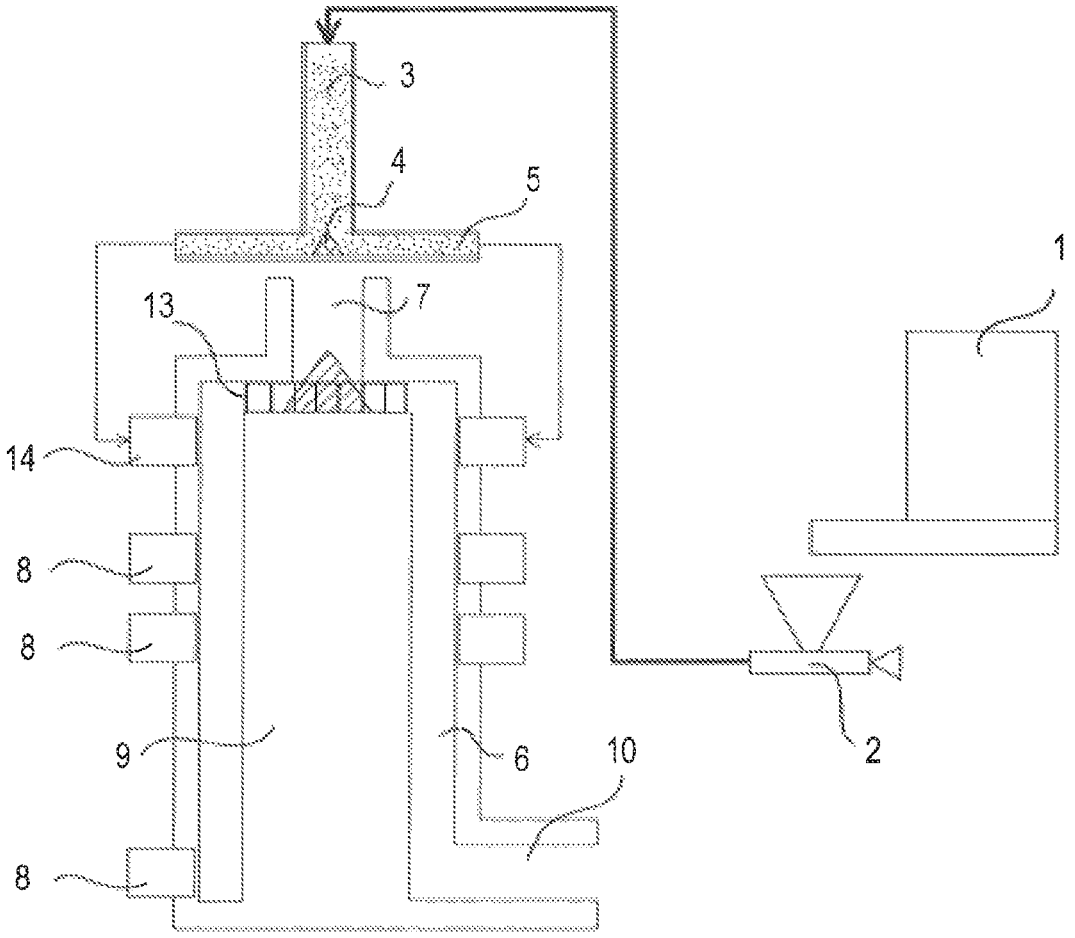
FIG. 1 is a view of a thermal spheroidizing treatment apparatus to be used in the present invention.

Preferred embodiments of the present invention will now be described in detail in accordance with the accompanying drawings.

A toner of the present invention includes: toner particles each containing a binder resin, a wax, and a coloring agent; and silica fine particles A and strontium titanate fine particles B present on surfaces of the toner particles, in which: the silica fine particles A have a number-average particle diameter (D1) of 60 nm or more and 300 nm or less; when a coverage rate of the surfaces of the toner particles with the silica fine particles A is defined as a coverage rate X (%) and a coverage rate with the silica fine particles A fixed to the surfaces of the toner particles is defined as a coverage rate Y (%), the coverage rate X is 20% or more and 95% or less, and a ratio [coverage rate Y/coverage rate X] of the coverage rate Y to the coverage rate X is 0.75 or more; the silica fine particles A are negatively chargeable; and the strontium titanate fine particles B are positively chargeable.

According to studies made by the inventors of the present invention, through the use of the above-mentioned toner, there can be provided a toner and a two-component developer each of which: shows a small fluctuation in charge quantity and a small fluctuation in image density even under a high-temperature and high-humidity environment; and does not cause any member contamination even after the formation of a large number of images and hence can stably output an image.

In order that the effects may be obtained, a toner having a high triboelectric charge quantity with a carrier needs to be designed. As described in Japanese Patent Application Laid-Open No. 2012-133338, the inventors of the present invention have attempted to obtain a toner having an additionally high triboelectric charge quantity from a toner to which silica fine particles have been fixed to be suppressed in liberation. When the chargeability of the carrier is improved for providing the toner having a high triboelectric charge quantity with the carrier, the following detrimental effect occurs: its electrostatic adhesive force increases and hence the carrier adheres to a photosensitive member. In view of the foregoing, the inventors of the present invention have attempted to increase the charge quantity of the toner through an approach not from the carrier but from the toner, and have made studies paying attention to an external additive in detail. As a result, the inventors have found that a desired charge quantity is achieved in a toner obtained by adding positively chargeable strontium titanate fine particles to toner particles having fixed thereto the silica fine particles.

Although the reason why such effects as described above are obtained in the present invention is not necessarily clear, the inventors have considered the reason why the problems have been solved to be as described below.

In the toner of the present invention, it is important that the toner particles be covered with the negative silica fine particles. The silica fine particles in the present invention are positioned in a negative direction in a charging series as compared with the toner particles, and hence when the strontium titanate fine particles are added, the fine particles are considered to selectively adhere to the silica fine particles with which the surfaces of the toner particles are covered. This is assumed to be because of the following reason: the silica fine particles are charged to a negative charge quantity as compared with the charge quantity of the toner particles, and hence the strontium titanate fine particles can adhere to the silica fine particles in a more electrostatically strong manner than to the toner particles. When an electric field is applied to the positively chargeable strontium titanate fine particles at the time of development, the fine particles are considered to receive a Coulomb force toward a lower potential. In contrast, when the electric field is applied to the negatively chargeable silica fine particles at the time of the development, the fine particles are considered to receive a Coulomb force toward a higher potential. That is, at the time of the development, the silica fine particles and the strontium titanate fine particles receive Coulomb forces so as to separate from each other, and hence the strontium titanate fine particles are assumed to be easily liberated from the silica fine particles. At this time, the toner of the present invention is considered to be capable of achieving a charge quantity much higher than the conventional one by virtue of an effect of peeling charging.

In the toner of the present invention, it is important that: the silica fine particles A have a number-average particle diameter (D1) of 60 nm or more and 300 nm or less; when the coverage rate of the surfaces of the toner particles with the silica fine particles A is defined as a coverage rate X (%) and a coverage rate with the silica fine particles A fixed to the surfaces of the toner particles is defined as a coverage rate Y (%), the coverage rate X be 20% or more and 95% or less, and the ratio [coverage rate Y/coverage rate X] of the coverage rate Y to the coverage rate X be 0.75 or more; the silica fine particles A be negative; and the strontium titanate fine particles B be positively chargeable.

In the present invention, it is important that the number-average particle diameter of the silica fine particles A be 60 nm or more and 300 nm or less, and the number-average particle diameter is preferably 70 nm or more and 280 nm or less. When the number-average particle diameter of the silica fine particles A falls within the range, the effect of peeling charging with the strontium titanate fine particles B is obtained at the time of development, and hence the effects of the present invention can be obtained.

When the number-average particle diameter is less than 60 nm, the silica fine particles are buried in the toner particles, the amount of the silica fine particles exposed to their surfaces reduces, and the coverage rate reduces. Accordingly, the area of contact with the strontium titanate fine particles B reduces and hence the peeling charging hardly occurs. Probably as a result of the foregoing, the charge quantity of the toner cannot be increased and the effects of the present invention are not obtained. When the number-average particle diameter of the silica fine particles A exceeds 300 nm, in the first place, the fine particles hardly adhere to the surface of the toner in an external addition step, and even after a fixing step, the coverage rate of the toner remains small. Probably as a result of the foregoing, the fine particles cannot contribute to an increase in charge quantity of the toner and the effects of the present invention are not obtained.

In the toner, it is important that the coverage rate X of the surfaces of the toner particles with the silica fine particles A be 20% or more and 95% or less, and the coverage rate is preferably 22% or more and 80% or less. When the coverage rate X falls within the range, the toner particles are covered with the silica fine particles A, and hence the number of particles that cause the peeling charging between the silica fine particles A and the strontium titanate fine particles B at the time of the development increases. The charging series of the silica fine particles A is more distant from that of the strontium titanate fine particles B than that of the toner particles is, and hence the charge quantity of the toner can be increased as compared with that in the case where the toner particles are not covered with the silica fine particles A.

When the coverage rate X is less than 20%, the area of the toner particles to be covered reduces. Accordingly, the number of particles that cause the peeling charging with the strontium titanate fine particles B at the time of the development reduces, and hence the effects of the present invention are not obtained. Any other external additive can be added to the toner of the present invention for exerting an effect such as the impartment of flowability. At this time, when the coverage rate X exceeds 95%, the coverage of the other external additive is inhibited, which leads to the deprivation of an effect of the addition of the external additive. Accordingly, a detrimental effect such as remarkable deterioration of the flowability of the toner occurs. The coverage rate X can be controlled depending on the particle diameters or addition number of parts of the strontium titanate fine particles B.

The addition number of parts of the silica fine particles A is preferably 2.0 parts by mass or more and 10.0 parts by mass or less when the amount of the toner particles is set to 100 parts by mass.

In the present invention, it is important that when the coverage rate with the silica fine particles A fixed to the surfaces of the toner particles is defined as the coverage rate Y (%), the ratio [coverage rate Y/coverage rate X] of the coverage rate Y to the coverage rate X be 0.75 or more, and the ratio is preferably 0.78 or more. The case where the ratio [coverage rate Y/coverage rate X] falls within the range means that the silica fine particles A are hardly liberated from the toner particles. Even when the toner particles are covered at a high rate, the silica fine particles A are easily liberated at the time of, for example, stirring in a developing device or the like as long as their adhesive force is small. In the present invention, it is important to establish a state where the silica fine particles A are hardly liberated because the charge quantity of the toner is increased by the peeling charging between the silica fine particles A and the strontium titanate fine particles B at the time of the development. When the ratio [coverage rate Y/coverage rate X] falls within the range, the silica fine particles A are fixed to the surfaces of the toner particles. Accordingly, the fine particles are not liberated from the toner particles even at the time of the development, and hence the charge quantity of the toner can be increased by the peeling charging.

The case where the ratio [coverage rate Y/coverage rate X] is less than 0.75 means that the silica fine particles with which the toner is covered are liberated. At this time, the effect of the peeling charging by the strontium titanate fine particles B fades and hence the charge quantity of the toner cannot be increased.

In order that the ratio [coverage rate Y/coverage rate X] may be caused to fall within the range, the step of fixing the silica fine particles A is preferably added. Although a fixing approach is not particularly limited, hot air treatment is preferably used. For example, a Henschel mixer has heretofore been used in the external addition step, and an external additive can be strongly fixed by extending its external addition time. However, when the hot air treatment is performed, the external additive can be fixed in a drastically strong manner as compared with the case where the external additive is externally added with the Henschel mixer in a strong manner.

In addition, it is necessary that the silica fine particles A be negatively chargeable and the strontium titanate fine particles B be positively chargeable.

In the present invention, as long as the positively chargeable strontium titanate fine particles B are added to the negatively chargeable silica fine particles A, the effect of the peeling charging is considered to be capable of being obtained when an electric field is applied to the toner at the time of the development. Accordingly, when the silica fine particles A are negatively chargeable and the strontium titanate fine particles B are positively chargeable, the effects of the present invention can be obtained. When the relationship is not satisfied, the charge quantity of the toner reduces and hence the effects cannot be obtained.

It should be noted that the toner of the present invention is preferably used as a negatively chargeable toner because the negatively chargeable silica fine particles A are present on the surfaces of the toner particles at a somewhat high coverage rate.

[Resin]

The binder resin to be incorporated into the toner particles of the present invention is not particularly limited, and any one of the following polymers and resins can be used.

There may be used, for example: homopolymers of styrene and substituted styrenes such as polystyrene, poly-p-chlorostyrene, and polyvinyltoluene; styrene-based copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, and a styrene-acrylonitrile-indene copolymer; and polyvinyl chloride, a phenol resin, a natural modified phenol resin, a natural resin-modified maleic acid resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

Of those, a polyester resin is preferably used from the viewpoints of low-temperature fixability and chargeability control.

The polyester resin to be preferably used in the present invention is a resin having a "polyester unit" in its binder resin chain. As a component constituting the polyester unit, there are specifically given, for example: a di- or higher hydric alcohol monomer component; and acid monomer components such as a di- or higher carboxylic acid, a di- or higher carboxylic anhydride, and a di- or higher carboxylic acid ester.

Examples of the di- or higher hydric alcohol monomer component include alkyleneoxide adducts of bisphenol A such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene.

Of those, an aromatic diol is preferably used as the alcohol monomer component. In the alcohol monomer component constituting the polyester resin, the aromatic diol is preferably contained at a ratio of 80 mol % or more.

On the other hand, examples of the acid monomer components such as the di- or higher carboxylic acid, the di- or higher carboxylic anhydride, and the di- or higher carboxylic acid ester include: aromatic dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; succinic acid substituted with an alkyl group or alkenyl group having 6 to 18 carbon atoms or an anhydride thereof; and unsaturated dicarboxylic acids such as fumaric acid, maleic acid, and citraconic acid or anhydrides thereof.

Of those, a polyhydric carboxylic acid such as terephthalic acid, succinic acid, adipic acid, fumaric acid, trimellitic acid, pyromellitic acid, benzophenonetetracarboxylic acid, or an anhydride thereof is preferably used as the acid monomer component.

In addition, the acid value of the polyester resin is preferably 1 mgKOH/g or more and 20 mgKOH/g or less form the viewpoint of higher stability of the triboelectric charge quantity of the toner.

It should be noted that the acid value can be set to fall within the range by adjusting the kind and blending amount of the monomer to be used in the resin. Specifically, the acid value can be controlled by adjusting an alcohol monomer component ratio or acid monomer component ratio at the time of the production of the resin, and the molecular weight of any such monomer. In addition, the acid value can be controlled by causing a terminal alcohol to react with a polyacid monomer (such as trimellitic acid) after ester condensation polymerization.

[Wax]

The wax to be used in the toner of the present invention is not particularly limited. Examples thereof include: a hydrocarbon-based wax such as low-molecular-weight polyethylene, low-molecular-weight polypropylene, an alkylene copolymer, microcrystalline wax, paraffin wax, or Fischer-Tropsch wax; an oxide of a hydrocarbon-based wax such as oxidized polyethylene wax or a block copolymerization product thereof; a wax containing a fatty acid ester as a main component, such as carnauba wax; and a wax obtained by subjecting part or all of fatty acid esters to deoxidization such as deoxidized carnauba wax. Further examples thereof include: a saturated linear fatty acid such as palmitic acid, stearic acid, or montanic acid; a unsaturated fatty acid such as brassidic acid, eleostearic acid, or parinaric acid; a saturated alcohol such as stearyl alcohol, an aralkyl alcohol, behenyl alcohol, carnaubyl alcohol, ceryl alcohol, or melissyl alcohol; a polyhydric alcohol such as sorbitol; an ester formed of a fatty acid such as palmitic acid, stearic acid, behenic acid, or montanic acid, and an alcohol such as stearyl alcohol, an aralkyl alcohol, behenyl alcohol, carnaubyl alcohol, ceryl alcohol, or melissyl alcohol; a fatty acid amide such as linoleamide, oleamide, or lauramide; a saturated fatty acid bisamide such as methylenebisstearamide, ethylenebiscapramide, ethylenebislauramide, or hexamethylenebisstearamide; an unsaturated fatty acid amide such as ethylenebisoleamide, hexamethylenebisoleamide, N,N'-dioleyladipamide, or N,N'-dioleylsebacamide; an aromatic bisamide such as m-xylenebisstearamide or N,N'-distearylisophthalamide; an aliphatic metal salt such as calcium stearate, calcium laurate, zinc stearate, or magnesium stearate (generally referred to as metal soap); a wax obtained by grafting aliphatic hydrocarbon-based wax with a vinyl-based monomer such as styrene or acrylic acid; a partially esterified product formed of a fatty acid such as behenic acid monoglyceride and a polyhydric alcohol; and a methyl ester compound having a hydroxyl group obtained by subjecting a vegetable oil and fat to hydrogenation.

Of those waxes, a hydrocarbon-based wax such as paraffin wax or Fischer-Tropsch wax is preferred from the viewpoint of improving the low-temperature fixability and fixation winding resistance of the toner.

The wax is preferably used at a content of 0.5 part by mass or more and 20 parts by mass or less with respect to 100 parts by mass of the binder resin. In addition, the peak temperature of the highest endothermic peak present in the temperature range of from 30° C. or more to 200° C. or less in an endothermic curve at the time of temperature increase to be measured with a differential scanning calorimeter (DSC) is preferably 50° C. or more and 110° C. or less from the viewpoint of compatibility between the storage stability and hot offset resistance of the toner.

[Coloring Agent]

As the coloring agent that can be incorporated into the toner of the present invention, there are given the following coloring agents.

As a black coloring agent, there are given: carbon black; and a coloring agent toned to a black color with a yellow coloring agent, a magenta coloring agent, and a cyan coloring agent. Although a pigment may be used alone as the coloring agent, a dye and the pigment are more preferably used in combination to improve the clarity of the coloring agent in terms of the quality of a full-color image.

As a magenta coloring pigment, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a magenta coloring dye, there are given, for example: oil-soluble dyes such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a cyan coloring pigment, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted by 1 to 5 phthalimidomethyl groups.

For example, C.I. Solvent Blue 70 is given as a cyan coloring dye.

As a yellow coloring pigment, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

For example, C.I. Solvent Yellow 162 is given as a yellow coloring dye.

The coloring agent is preferably used in an amount of 0.1 part by mass or more and 30 parts by mass or less with respect to 100 parts by mass of the binder resin.

[Charge Control Agent]

The toner of the present invention may contain a charge control agent as required. The toner of the present invention can be suitably used as a negatively chargeable toner, and as the charge control agent, a known agent may be adopted. In particular, a metal compound of an aromatic carboxylic acid, which is colorless, provides a high charging speed of the toner, and can stably maintain a constant charge quantity, is preferred.

As a negative charge control agent, there are given a metal salicylate compound, a metal naphthoate compound, a metal dicarboxylate compound, a polymeric compound having a sulfonic acid or a carboxylic acid in a side chain, a polymeric compound having a sulfonic acid salt or a sulfonic acid ester in a side chain, a polymeric compound having a carboxylic acid salt or a carboxylic acid ester in a side chain, a boron compound, a urea compound, a silicon compound, and a calixarene. The charge control agent may be internally added to each of the toner particles, or may be externally added thereto. The addition amount of the charge control agent is preferably 0.2 part by mass or more and 10 parts by mass or less with respect to 100 parts by mass of the binder resin.

[Silica Fine Particles A]

Silica fine particles A produced by an arbitrary method such as a wet method, a flame-melting method, or a vapor phase method are preferably used as the silica fine particles.

The wet method is, for example, a sol-gel method involving: dropping an alkoxysilane in an organic solvent in which water is present; subjecting the mixture to hydrolysis and a condensation reaction with a catalyst; removing the solvent from the resultant silica sol suspension; and drying the residue to provide a sol-gel silica.

The flame-melting method is, for example, a method involving: gasifying a silicon compound that is gaseous or liquid at normal temperature in advance; and then decomposing and melting the silicon compound in an outer flame, which is formed by supplying a combustible gas formed of hydrogen and/or a hydrocarbon, and oxygen, to provide the silica fine particles (molten silica). In the flame-melting method, the following can be performed: in the outer flame, simultaneously with the production of the silica fine particles from the silicon compound, the silica fine particles are caused to fuse and coalesce with each other so that the particles may have desired particle diameters and shapes, and then the resultant is cooled and collected with a bag filter or the like. The silicon compound to be used as a raw material is not particularly limited as long as the compound is gaseous or liquid at normal temperature. Examples thereof include: a cyclic siloxane such as hexamethylcyclotrisiloxane, octamethylcyclotetrasiloxane, or decamethylcyclopentasiloxane; a siloxane such as hexamethyldisiloxane or octamethyltrisiloxane; an alkoxysilane such as tetramethoxysilane, tetraethoxysilane, methyltrimethoxysilane, or dimethyldimethoxysilane; an organic silane compound such as tetramethylsilane, diethylsilane, or hexamethyldisilazane; a silicon halide such as monochlorosilane, dichlorosilane, trichlorosilane, or tetrachlorosilane; and an inorganic silicon compound such as monosilane or disilane.

The vapor phase method is, for example, a fumed method involving burning silicon tetrachloride together with a mixed gas of oxygen, hydrogen, and a diluent gas (such as nitrogen, argon, or carbon dioxide) at high temperature to produce the silica fine particles.

The silica fine particles are preferably subjected to surface treatment for the purpose of subjecting their surfaces to hydrophobizing treatment. A silane coupling agent or a silicone oil is preferably used as a surface treatment agent to be used at this time.

Examples of the silane coupling agent include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, a triorganosilylmercaptan, trimethylsilylmercaptan, a triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing one hydroxyl group bonded to a silicon atom in a unit positioned at each end.

Examples of the silicone oil to be used in the treatment of the inorganic fine ponder (silica fine particles) to be used in the present invention include a dimethyl silicone oil, an alkyl-modified silicone oil, an α-methylstyrene-modified silicone oil, a chlorophenyl silicone oil, and a fluorine-modified silicone oil. The silicone oil is not limited to those described above. The silicone oil preferably has a viscosity at a temperature of 25° C. of from 50 to 1,000 $mm^2/s$. When the viscosity is less than 50 $mm^2/s$, the application of heat volatilizes part of the oil and hence the charging characteristic of the toner is liable to deteriorate. When the viscosity exceeds 1,000 $mm^2/s$, it becomes difficult to handle the oil in a treating operation. A known technology can be adopted as a method for silicone oil treatment. Examples of the method include: a method involving mixing silicic acid fine powder and the silicone oil by using a mixer; a method involving spraying the silicic acid fine powder with the silicone oil by using an atomizer; and a method involving dissolving the silicone oil in a solvent and mixing the solution with the silicic acid fine powder. The treatment method is not limited thereto.

The silica fine particles A are preferably treated with hexamethyldisilazane or the silicone oil as a surface treatment agent.

With regard to the charge quantity QA of the silica fine particles A, the term "negatively chargeable" is defined that a charge quantity determined by measuring a triboelectric charge quantity involving using a standard carrier for a negative charging polarity toner to be described later is −200 (mC/kg) or more and −20 (mC/kg) or less.

[Strontium Titanate B]

Strontium titanate B to be used in the present invention preferably has a perovskite crystal structure. Such strontium titanate can be synthesized by, for example, adding a hydroxide of strontium to the dispersion of a titania sol, which is obtained by adjusting the pH of a titanium hydroxide-containing slurry obtained by hydrolyzing an aqueous solution of titanyl sulfate, and warming the mixture to a reaction temperature. A titania sol having a good degree of crystallinity and a good particle diameter is obtained by setting the pH of the titanium hydroxide-containing slurry to from 0.5 to 1.0. In addition, an alkaline substance such as sodium hydroxide is preferably added to the dispersion of the titania sol for the purpose of removing an ion adsorbing to a titania sol particle. At this time, in order that a sodium ion or the like may be prevented from adsorbing to a titanium hydroxide surface, it is not preferred to set the pH of the slurry to 7 or more. In addition, the reaction temperature is preferably from 60° C. to 100° C., and in order that a desired particle size distribution may be obtained, a rate of temperature increase is preferably set to 30° C./hr or less and a reaction time is preferably from 3 to 7 hours.

Any one of the following methods is available as a method of subjecting strontium titanate produced by such method as described above to surface treatment with a fatty acid or a metal salt thereof. For example, a fatty acid can be precipitated on a perovskite crystal surface by charging a strontium titanate slurry into a fatty acid sodium aqueous solution under an Ar gas or $N_2$ gas atmosphere. In addition, for example, a fatty acid metal salt can be precipitated on, and caused to adsorb to, the perovskite crystal surface by charging the strontium titanate slurry into the fatty acid sodium aqueous solution under the Ar gas or $N_2$ gas atmosphere, and dropping a desired metal salt aqueous solution to the mixture while stirring the mixture. For example, aluminum stearate can be caused to adsorb to the surface by using an aqueous solution of sodium stearate and aluminum sulfate.

The strontium titanate fine particles B preferably use a fatty acid or a fatty acid metal salt as a surface treatment agent. The fatty acid is not particularly limited, and as the kind of the fatty acid, there is preferably used a C14-22 saturated fatty acid such as myristic acid, pentadecylic acid, palmitic acid, margaric acid, tuberculostearic acid, arachidic acid, or behenic acid. In addition, a fatty acid sodium salt or a fatty acid potassium salt is preferably used as the fatty acid metal salt.

The strontium titanate fine particles B are preferably treated with 0.5 part by mass or more and 10 parts by mass or less of the surface treatment agent when the amount of the original body is set to 100 parts by mass.

The strontium titanate fine particles B are preferably used in combination with the silica fine particles A using hexamethyldisilazane or a silicone oil as a surface treatment agent.

The term "positively chargeable" is defined that a charge quantity of the strontium titanate fine particles B determined by measuring a triboelectric charge quantity involving using a standard carrier for a negative charging polarity toner to be described later is +20 (mC/kg) or more and +200 (mC/kg) or less.

The fixing rate of the strontium titanate fine particles B is preferably 0.10 or more and 0.60 or less. When the fixing rate of the strontium titanate fine particles B falls within the range, the strontium titanate fine particles B easily peel at the time of the development and hence the effect of the peeling charging is easily obtained.

The addition amount of the strontium titanate fine particles B is preferably 0.2 part by mass or more and 1.0 part by mass or less when the amount of the toner particles is set to 100 parts by mass. When the addition amount of the strontium titanate fine particles B falls within the range, the fixing rate of the strontium titanate fine particles B easily falls within the range of from 0.10 or more to 0.60 or less, and hence the effects of the present invention are easily obtained.

Primary particles of the strontium titanate fine particles B preferably have a number-average particle diameter of 30 nm or more and 300 nm or less. When the number-average particle diameter of primary particles of the strontium titanate fine particles B falls within the range, the effect of the peeling charging with the silica fine particles A fixed to the surfaces of the toner particles is easily obtained, and hence the effects of the present invention are easily obtained.

It is preferred that the strontium titanate fine particles B be each a perovskite crystal, and particle shapes thereof be each a cubic shape, a rectangular parallelepiped shape, or a mixture thereof. When the shape of each of the strontium titanate fine particles B is a cubic shape or a rectangular parallelepiped shape, the area of contact between the silica fine particles A and the strontium titanate fine particles B increases, and the effect of the peeling charging with the silica fine particles A fixed to the surfaces is easily obtained, and hence the effects of the present invention are easily obtained.

[Carrier]

The toner of the present invention is preferably used as a two-component developer by being mixed with a magnetic carrier because a stable image is obtained over a long time period.

A generally known carrier can be used as the magnetic carrier, and examples thereof include: magnetic materials such as surface-oxidized iron powder or unoxidized iron powder, metal particles such as iron, lithium, calcium, magnesium, nickel, copper, zinc, cobalt, manganese, and rare earths, and alloy particles, oxide particles, and ferrites thereof; and a magnetic material-dispersed resin carrier (the so-called resin carrier) containing a magnetic material and a binder resin holding the magnetic material in a state where the magnetic material is dispersed therein.

In addition, in order that the effects of the toner of the present invention may be maximally exerted, a carrier which has a carrier core, and in which the surface of the carrier core is covered with a copolymer containing, as copolymerization components, a monomer having a structure represented by the following formula (1) and a macromonomer having a structure represented by the following formula (2) is preferably used.

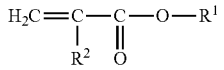

(1)

(In the formula, $R^1$ represents a hydrocarbon group having 4 or more carbon atoms, and $R^2$ represents H or $CH_3$.)

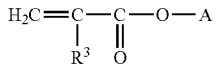

(2)

(In the formula, A represents an alicyclic hydrocarbon group having 5 or more and 10 or less carbon atoms, or a polymer using, as a polymerization component, one or two or more kinds of compounds selected from the group consisting of methyl acrylate, methyl methacrylate, butyl acrylate, butyl methacrylate, 2-ethylhexyl acrylate, 2-ethylhexyl methacrylate, styrene, and acrylonitrile, and $R^3$ represents H or $CH_3$.)

The carrier of the present invention can charge the strontium titanate fine particles B to an additionally positive value and the toner covered with the silica fine particles A to an additionally negative value. The foregoing is considered to be capable of additionally improving the effect of the peeling charging at the time of the development. Although the reason for the foregoing has not been necessarily elucidated, the foregoing is assumed to be based on an interaction with the copolymer covering the core.

The mixing ratio of the magnetic carrier is preferably set to 2 mass % or more and 15 mass % or less in terms of a toner concentration in the two-component developer, and is more preferably set to 4 mass % or more and 13 mass % or less because a good result is typically obtained.

[External Additive]

In the present invention, an external additive may be further added for improving the flowability, and adjusting the triboelectric charge quantity, of the toner as required.

The external additive is preferably inorganic fine particles such as silica, titanium oxide, aluminum oxide, and strontium titanate. The inorganic fine particles are preferably subjected to hydrophobic treatment with a hydrophobizing agent such as a silane compound, a silicone oil, or a mixture thereof.

With regard to the specific surface area of the external additive to be used, inorganic fine particles having a specific surface area of 10 $m^2/g$ or more and 50 $m^2/g$ or less are preferred from the viewpoint of the suppression of the embedment of the external additive.

In addition, the external additive is preferably used in an amount of 0.1 part by mass or more and 5.0 parts by mass or less with respect to 100 parts by mass of the toner particles.

Although a known mixer such as a Henschel mixer can be used in the mixing of the toner particles and the external additive, the apparatus is not particularly limited as long as the apparatus can perform the mixing.

[Production Method]

A method of producing the toner of the present invention is not particularly limited and a known production method can be employed. Here, description is given by taking a method of producing the toner involving employing a pulverization method as an example.

In a raw material-mixing step, predetermined amounts of, for example, the binder resin and the wax, and as required, any other component such as the coloring agent or the charge control agent as materials constituting the toner particles are weighed, and the materials are blended and mixed. A mixing apparatus is, for example, a double cone mixer, a V-type mixer, a drum-type mixer, a super mixer, a Henschel mixer, a Nauta mixer, or a Mechano Hybrid (manufactured by NIPPON COKE & ENGINEERING CO., LTD.).

Next, the mixed materials are melt-kneaded to disperse the wax and the like in the binder resin. In the melt-kneading step, a batch-type kneader such as a pressure kneader or a Banbury mixer, or a continuous kneader can be used, and a single-screw or twin-screw extruder has been in the mainstream because of the following superiority: the extruder can perform continuous production. Examples of the extruder include a KTK-type twin-screw extruder (manufactured by Kobe Steel, Ltd.), a TEM-type twin-screw extruder (manufactured by TOSHIBA MACHINE CO., LTD.), a PCM kneader (manufactured by Ikegai Corp), a twin-screw extruder (manufactured by KCK CO., LTD.), a co-kneader (manufactured by BUSS), and a KNEADEX (manufactured by NIPPON COKE & ENGINEERING CO., LTD.). Further, the resin composition obtained by the melt-kneading may be rolled with a twin-roll mill or the like, and may be cooled with water or the like in a cooling step.

Next, the cooled resin composition is pulverized in a pulverization step until the desired particle diameter is attained. In the pulverization step, the composition is coarsely pulverized with, for example, a pulverizer such as a crusher, a hammer mill, or a feather mill, and then finely pulverized with, for example, a Kryptron System (manufactured by Kawasaki Heavy Industries, Ltd.), a SUPER ROTOR (manufactured by Nisshin Engineering Inc.), a Turbo Mill (manufactured by Turbo Kogyo Co., Ltd.), or a fine pulverizer using an air jet system.

After that, the resultant is subjected to classification with a classifier or sieving machine such as an Elbow-Jet of an inertial classification system (manufactured by NITTETSU MINING CO., LTD), a Turboplex of a centrifugal classification system (manufactured by Hosokawa Micron), a TSP Separator (manufactured by Hosokawa Micron), or a Faculty (manufactured by Hosokawa Micron) as required. Thus, the toner particles are obtained.

In addition, after the pulverization, surface treatment for the toner particles such as spheroidizing treatment may be performed with a Hybridization System (manufactured by NARA MACHINERY CO., LTD.), a Mechanofusion System (manufactured by Hosokawa Micron), a Faculty (manufactured by Hosokawa Micron), or a Meteorainbow MR Type (manufactured by Nippon Pneumatic Mfg. Co., Ltd.) as required.

In particular, in the present invention, the silica fine particles A are dispersed in the surfaces of the toner particles obtained by the production method, and the silica fine particles A in the dispersed state are fixed to the surfaces of the toner particles by surface treatment with hot air.

In the present invention, the toner is preferably obtained by, for example, performing the surface treatment with hot air through the use of a surface treatment apparatus illustrated in FIG. 1 and performing classification as required.

Here, the outline of a method for the surface treatment with hot air is described with reference to FIG. 1, but the present invention is not limited thereto. FIG. 1 is a sectional view illustrating an example of the surface treatment apparatus used in the present invention.

A mixture supplied in a constant amount by a raw material constant amount supply unit 1 is introduced into an introduction pipe 3 placed on the vertical line of the raw material supply unit by a compressed gas adjusted by a compressed gas-adjusting unit 2. The mixture that has passed the introduction pipe is uniformly dispersed by a conical protruded member 4 provided at the central portion of the raw material supply unit, is introduced into supply pipes 5 radially extending in 8 directions, and is introduced into a treatment chamber 6 where heat treatment is performed.

At this time, the flow of the mixture supplied to the treatment chamber is regulated by a regulating unit 9 for regulating the flow of a mixture, the unit being provided in the treatment chamber. Accordingly, the mixture supplied to the treatment chamber is subjected to the heat treatment while swirling in the treatment chamber, and then the mixture is cooled.

Hot air for thermally treating the supplied mixture is supplied from a hot air supply unit 7, and the hot air is spirally swirled by a swirling member 13 for swirling the hot air to be introduced into the treatment chamber. With regard to the construction of the swirling member 13 for swirling the hot air, the member has a plurality of blades, and can control the swirl of the hot air depending on the number of, and an angle between, the blades. The temperature of the hot air to be supplied into the treatment chamber at the outlet portion of the hot air supply unit 7 is preferably from 100° C. to 300° C. When the temperature at the outlet portion of the hot air supply unit falls within the range, the toner particles can be uniformly subjected to spheroidizing treatment while the fusion and coalescence of the toner particles due to excessive heating of the mixture are prevented.

Further, the thermally treated toner particles that have been subjected to the heat treatment are cooled by cold air supplied from a cold air supply unit 8, and the temperature of the cold air supplied from the cold air supply unit 8 is preferably from −20° C. to 30° C. When the temperature of the cold air falls within the range, the thermally treated toner particles can be efficiently cooled, and the fusion and coalescence of the thermally treated toner particles can be prevented without the inhibition of the uniform spheroidizing treatment for the mixture. The absolute water content of the cold air is preferably 0.5 $g/m^3$ or more and 15.0 $g/m^3$ or less.

Next, the thermally treated toner particles that have been cooled are recovered by a recovery unit 10 positioned at the lower end of the treatment chamber. It should be noted that the recovery unit is constituted as follows: a blower (not shown) is provided at the tip of the unit, and the particles are sucked and conveyed by the blower.

In addition, a powder particle supply port 14 is provided so that the swirling direction of the supplied mixture and the swirling direction of the hot air may be identical to each other, and the recovery unit 10 of the surface treatment apparatus is provided on the outer peripheral portion of the treatment chamber so that the swirling direction of a swirled powder particle may be maintained. Further, the cold air supplied from the cold air supply unit 8 is constituted so as to be supplied from the outer peripheral portion of the apparatus to the inner peripheral surface of the treatment chamber from horizontal and tangential directions. The swirling direction of the toner to be supplied from the powder particle supply port, the swirling direction of the cold air supplied from the cold air supply unit, and the swirling direction of the hot air supplied from the hot air supply unit are identical to one another. Accordingly, no turbulence occurs in the treatment chamber, a swirl flow in the apparatus is strengthened, a strong centrifugal force is applied to the toner, and the dispersibility of the toner additionally improves, and hence a toner having a small number of coalesced particles and having a uniform shape can be obtained.

After that, the cooled toner particles are sucked by the blower, passed through a transport pipe, and recovered by a cyclone or the like.

In addition, surface modification and spheroidizing treatment may be further performed with a Hybridization System manufactured by NARA MACHINERY CO., LTD. or a Mechanofusion System manufactured by Hosokawa Micron Corporation as required. In such case, a sieving machine such as an air sieve HIBOLTER (manufactured by SHIN-TOKYO KIKAI CO., LTD.) may be used as required.

After that, the strontium titanate fine particles B and the other inorganic fine particles can be externally added to impart flowability to, and improve the charging stability of, the toner. A mixing apparatus is, for example, a double cone mixer, a V-type mixer, a drum-type mixer, a super mixer, a Henschel mixer, a Nauta mixer, or a Mechano Hybrid (manufactured by NIPPON COKE & ENGINEERING CO., LTD.).

Next, methods of measuring respective physical properties related to the present invention are described.

[Calculation of Coverage Rate X]

The coverage rate X in the present invention is calculated by analyzing a toner surface image, which is photographed with a Hitachi ultra-high resolution field-emission scanning electron microscope S-4800 (Hitachi High-Technologies Corporation), with an image analysis software Image-Pro Plus ver. 5.0 (NIPPON ROPER K.K.). Conditions under which the image is photographed with the S-4800 are as described below.

(1) Sample Production

A conductive paste is applied in a thin manner to a sample stage (aluminum sample stage measuring 15 mm by 6 mm) and the top of the paste is sprayed with the toner. Further, air blowing is performed to remove excess toner from the sample stage and to dry the remaining toner sufficiently. The sample stage is set in a sample holder and the height of the sample stage is regulated to 36 mm with a sample height gauge.

(2) Setting of Conditions for Observation with S-4800

The calculation of the coverage rate X is performed with an image obtained by reflected electron image observation with the S-4800. A reflected electron image is reduced in charge-up of the inorganic fine particles as compared with a secondary electron image, and hence the coverage rate X can be measured with high accuracy.

Liquid nitrogen is poured into an anti-contamination trap attached to the mirror body of the S-4800 until the liquid overflows, and the trap is left for 30 minutes. The "PC-SEM" of the S-4800 is activated to perform flushing (the cleaning of an FE chip as an electron source). The acceleration voltage display portion of a control panel on a screen is clicked and a [Flushing] button is pressed to open a flushing execution dialog. After it has been confirmed that a flushing intensity is 2, the flushing is executed. It is confirmed that an emission current by the flushing is from 20 to 40 μA. The sample holder is inserted into the sample chamber of the mirror body of the S-4800. [Origin] on the control panel is pressed to move the sample holder to an observation position.

The acceleration voltage display portion is clicked to open an HV setting dialog, and an acceleration voltage and the emission current are set to [0.8 kV] and [20 μA], respectively. In the [Basic] tab of an operation panel, signal selection is placed in [SE], and [Upper (U)] and [+BSE] are selected for an SE detector. In the right selection box of [+BSE], [L.A. 100] is selected to set a mode in which observation is performed with a reflected electron image. Similarly, in the [Basic] tab of the operation panel, the probe current, focus mode, and WD of an electronic optical system condition block are set to [Normal], [UHR], and [3.0 mm], respectively. The [ON] button of the acceleration voltage display portion of the control panel is pressed to apply the acceleration voltage.

(3) Focus Adjustment

The focus knob [COARSE] of the operation panel is rotated, and after some degree of focusing has been achieved, aperture alignment is adjusted. The [Align] of the control panel is clicked to display an alignment dialog and [Beam] is selected. The STIGMA/ALIGNMENT knob (X, Y) of the operation panel is rotated to move a beam to be displayed to the center of a concentric circle. Next, [Aperture] is selected and the STIGMA/ALIGNMENT knob (X, Y) is rotated by one to perform focusing so that the movement of an image may be stopped or minimized. The aperture dialog is closed and focusing is performed by autofocusing. After that, a magnification is set to 50,000 (50 k), focus adjustment is performed with the focus knob and the STIGMA/ALIGNMENT knob in the same manner as in the foregoing, and focusing is performed again by autofocusing. Focusing is performed by repeating the foregoing operations again. Here, when the tilt angle of a surface to be observed is large, the accuracy with which the coverage rate is measured is liable to reduce. Accordingly, a toner particle whose surface has as small a tilt as possible is selected and analyzed by selecting such a toner particle that the entire surface to be observed is simultaneously in focus upon focus adjustment.

(4) Image Storage

Brightness adjustment is performed according to an ABC mode, and a photograph is taken at a size of 640×480 pixels and stored. The following analysis is performed with the image file. One photograph is taken for one toner particle and images are obtained for at least 30 toner particles.

(5) Image Analysis

In the present invention, the coverage rate X is calculated by subjecting the image obtained by the approach described above to binary coded processing with the following analysis software. At this time, the one screen is divided into 12 squares and each square is analyzed. Conditions under which the analysis is performed with the image analysis software Image-Pro Plus ver. 5.0 are as described below.

Software Image-Pro Plus 5.1J

"Count/size" and "Option" are selected from the "Measurement" of a tool bar in the stated order to set binarization conditions. "8 connect" is selected in an object extraction option and smoothing is set to 0. In addition, "Pre-Filter", "Fill Holes", and "Convex Hull" are not selected, and "Clean Borders" is set to "None". "Measurement item" is selected from the "Measurement" of the tool bar and "2 to 107" is input to an area screening range.

The coverage rate is calculated by surrounding a square region. At this time, the surrounding is performed so that the area (C) of the region may be from 24,000 to 26,000 pixels. Auto-binarization is performed by "Processing"-binarization to calculate the total sum (D) of the areas of silica-free regions.

A coverage rate a is determined from the area C of the square region and the total sum D of the areas of the silica-free regions by using the following equation.

At this time, particles each having a particle diameter of less than 60 nm observed on the image are excluded because the particles are not counted as the silica fine particles A. In addition, cubic or parallelepiped particles are excluded from the count because the particles are the strontium titanate fine particles.

$$\text{Coverage rate } a\ (\%)=100-(D/C\times 100)$$

The average of all obtained data is defined as the coverage rate X in the present invention.

[Calculation of Coverage Rate Y of Silica Fine Particles]

The coverage rate Y is calculated by first removing the inorganic fine particles not fixed to the surface of the toner and then performing the same operations as those of the calculation of the coverage rate a.

(1) Removal of Inorganic Fine Particles that are not Fixed

The inorganic fine particles that are not fixed are removed as described below.

160 Grams of sucrose are added to 100 ml of ion-exchanged water and are dissolved therein while being warmed with hot water to prepare a sucrose solution. A solution prepared by adding 23 ml of the sucrose solution and 6.0 ml of a nonionic surfactant, preferably Contaminon N (manufactured by Wako Pure Chemical Industries, Ltd.: trade name) is charged into a 50-ml sample bottle made of polyethylene that can be sealed, 1.0 g of a measurement sample is added to the solution, and the mixture is stirred by lightly shaking the sealed bottle. After that, the bottle is left at rest for 1 hour. The sample that has been left at rest for 1 hour is shaken with a KM Shaker (Iwaki Sangyo: trade name) at 350 spm for 20 minutes. At this time, the angle at which the sample is shaken is as follows: when the directly upward direction (vertical) of the shaker is defined as 0°, a strut to be shaken is adapted to move forward by 15° and to move backward by 20°. The sample bottle is fixed to a fixing holder (obtained by fixing the lid of the sample bottle onto the extension of the center of the strut) attached to the tip of the strut. The shaken sample is quickly transferred to a container for centrifugation. The sample that has been transferred to the container for centrifugation is centrifuged with a high-speed refrigerated centrifuge H-9R (manufactured by KOKUSAN Co., Ltd.: trade name) under the following conditions: a preset temperature is 20° C., a time period for acceleration and deceleration is the shortest, the number of rotations is 3,500 rpm, and a time of rotation is 30 minutes. The toner separated in the uppermost portion is recovered and filtered out with a vacuum filter, followed by drying with a dryer for 1 hour or more.

(2) Calculation of Coverage Rate Y

The coverage rate of the toner after the drying is calculated in the same manner as in the coverage rate X. Thus, the coverage rate Y is obtained.

[Calculation of Fixing Rate of Strontium Titanate Fine Particles B]

The fixing rate of the strontium titanate fine particles B is calculated by the same approach as those of the coverage rate X and coverage rate Y of the silica fine particles A.

The area of only the strontium titanate fine particles B excluded from the count at the time of the operation (5) is calculated and their coverage rate is calculated by the same approach. Further, the same operations are performed upon calculation of the coverage rate Y and the coverage rate of the strontium titanate fine particles B after the removal is also calculated.

The fixing rate of the strontium titanate fine particles B is calculated from the two coverage rates in the same manner as in the silica fine particles A.

[Calculation of Number-Average Particle Diameter of Silica Fine Particles A]

The number-average particle diameter of the primary particles of the silica fine particles A is calculated from an image of the surface of the toner photographed with a Hitachi ultra-high resolution field-emission scanning electron microscope S-4800 (Hitachi High-Technologies Corporation). Conditions under which the image is photographed with the S-4800 are as described below.

The operations from (1) to (2) are performed in the same manner as in the section "calculation of coverage rate X," and the surface of the toner is brought into focus in the same manner as in the operation (3) by performing focus adjustment at a magnification of 50,000. After that, brightness adjustment is performed according to the ABC mode. After that, the magnification is set to 100,000, and then focus adjustment is performed with the focus knob and the STIGMA/ALIGNMENT knob in the same manner as in the operation (3). Further, focusing is performed by autofocusing. Focusing is performed at a magnification of 100,000 by repeating the focus adjustment operation again.

After that, the particle diameters of at least 300 inorganic fine particles on the surface of the toner are measured and the number-average particle diameter of their primary particles is determined. Here, some of the silica fine particles A exist as an agglomerated lump. Accordingly, the maximum diameter of the particles that can be identified as a primary particle is determined, and the number-average particle diameter of the primary particles is obtained by taking the arithmetic average of the resultant maximum diameters.

At this time, cubic or parallelepiped particles are excluded from the count because the particles are the strontium titanate fine particles.

[Calculation of Number-Average Particle Diameter of Strontium Titanate Fine Particles B]

Only the strontium titanate fine particles B excluded upon calculation of the number-average particle diameter of the silica fine particles A are picked up and their number-average particle diameter is calculated by the same approach.

[Calculation of Charge Quantity]

Figure 2:
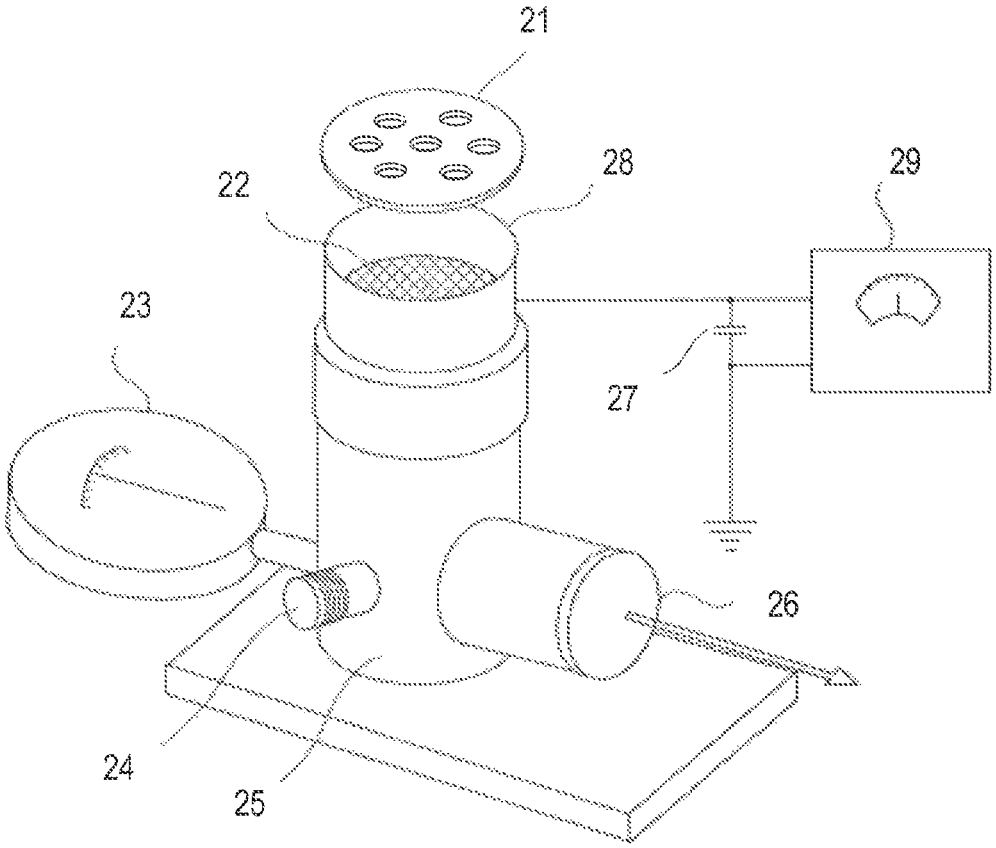
FIG. 2 is a diagram illustrating an apparatus for measuring the charge quantities of silica fine particles A and strontium titanate fine particles B.

The charge quantity QA (mC/kg) of the silica fine particles A and the charge quantity QB (mC/kg) of the strontium titanate fine particles B in the present invention are calculated as described below. Measurement is performed under an environment having a temperature of 23° C. and a relative humidity of 50% by using a standard carrier for a negative charging polarity toner (manufactured by The Imaging Society of Japan) as a carrier. A mixture obtained by adding 0.1 g of a sample whose chargeability is to be measured to 9.9 g of the carrier is loaded into a bottle made of polyethylene having a volume of 50 ml, and the bottle is left at rest for 12 hours. Next, the bottle is shaken with a shaker Model-YS-LD (manufactured by YAYOI CO., LTD.) at 150 rpm for 2 minutes. Next, in a triboelectric charge quantity-measuring apparatus illustrated in FIG. 2, 0.4 g of the mixture is loaded into a metal measuring container 28 having a 635-mesh screen 22 at its bottom, and a metal lid 21 is placed on the container. The mass of the entirety of the measuring container 28 at this time is weighed and represented by W1 (g). Next, the mixture is sucked with a sucker 25 (at least a portion of which in contact with the measuring container 28 is an insulator) from a suction port 26, and the pressure of a vacuum gauge 23 is set to 2 kPa by regulating an air flow-regulating valve 24. The suction is performed in the state for 1 minute to suck and remove the silica fine particles A or the strontium titanate fine particles B used as the sample. The potential of a potentiometer 29 at this time is represented by V (volt(s)). Here, the capacitance of a capacitor 27 is represented by C (μF). In addition, the mass of the entirety of the measuring apparatus after the suction is weighed and represented by W2 (g). The triboelectric charge quantity Q (mC/kg) of the sample is calculated from the following equation.

$$Q=-CV/(W1-W2)$$

The basic construction of the present invention has been described above. Now, the present invention is specifically described based on Examples. However, the present invention is by no means limited thereto.

[Production Example of Binder Resin 1]

76.9 Parts by mass (0.167 mol) of polyoxypropylene(2.2)-2,2-bis(4-hydroxyphenyl)propane, 24.1 parts by mass (0.145 mol) of terephthalic acid, and 0.5 part by mass of titanium tetrabutoxide were loaded into a 4-liter, four-necked flask made of glass. A temperature gauge, a stirring rod, a condenser, and a nitrogen introducing tube were attached to the flask, and the flask was set in a mantle heater. Next, air in the flask was replaced with a nitrogen gas. After that, a temperature in the flask was gradually increased while the mixture was stirred. The mixture was subjected to a reaction for 4 hours while being stirred at a temperature of 200° C. (first reaction step). After that, 2.0 parts by mass (0.010 mol) of trimellitic anhydride were added to the resultant, and the mixture was subjected to a reaction at 180° C. for 1 hour (second reaction step) to provide a binder resin 1.

The binder resin 1 had an acid value of 10 mgKOH/g and a hydroxyl value of 65 mgKOH/g. In addition, its molecular weights measured by GPC were as follows: a weight-average molecular weight (Mw) of 8,000, a number-average molecular weight (Mn) of 3,500, and a peak molecular weight (Mp) of 5,700. The resin had a softening point of 90° C.

[Production Example of Binder Resin 2]

71.3 Parts by mass (0.155 mol) of polyoxypropylene(2.2)-2,2-bis(4-hydroxyphenyl)propane, 24.1 parts by mass (0.145 mol) of terephthalic acid, and 0.6 part by mass of titanium tetrabutoxide were loaded into a 4-liter, four-necked flask made of glass. A temperature gauge, a stirring rod, a condenser, and a nitrogen introducing tube were attached to the flask, and the flask was set in a mantle heater. Next, air in the flask was replaced with a nitrogen gas. After that, a temperature in the flask was gradually increased while the mixture was stirred. The mixture was subjected to a reaction for 2 hours while being stirred at a temperature of 200° C. (first reaction step). After that, 5.8 parts by mass (0.030 mol %) of trimellitic anhydride were added to the resultant, and the mixture was subjected to a reaction at 180° C. for 10 hours (second reaction step) to provide a binder resin 2.

The binder resin 2 had an acid value of 15 mgKOH/g and a hydroxyl value of 7 mgKOH/g. In addition, its molecular weights measured by GPC were as follows: a weight-average molecular weight (Mw) of 200,000, a number-average molecular weight (Mn) of 5,000, and a peak molecular weight (Mp) of 10,000. The resin had a softening point of 130° C.

[Production Example of Silica Fine Particles A1]

In the production of silica fine particles A1, a hydrocarbon-oxygen mixed burner of a double tube structure capable of forming an inner flame and an outer flame was used as a combustion furnace. A two fluid nozzle for slurry injection is set at the central portion of the burner and a silicon compound as a raw material is introduced. A combustible gas formed of a hydrocarbon and oxygen is injected from the surroundings of the two fluid nozzle to form an inner flame and outer flame as a reducing atmosphere. The atmosphere, a temperature, the length of each flame, and the like are adjusted by controlling the amounts and flow rates of the combustible gas and oxygen. Silica fine particles are formed from the silicon compound in the flames, and are fused together until a desired particle diameter is obtained. After that, the particles are cooled and then collected with a bag filter or the like, whereby the silica fine particles are obtained.

Silica fine particles were produced by using hexamethylcyclotrisiloxane as the silicon compound as a raw material. 100 Parts by mass of the resultant silica fine particles were subjected to surface treatment with 4 mass % of hexamethyldisilazane. The surface-treated silica fine particles are defined as silica fine particles A1. Table 1 summarizes their number average particle diameter of primary particles, treatment agent, and physical property.

[Production Example of Silica Fine Particles A2]

Silica fine particles A2 were produced by the same approach as that of the silica fine particles A1 except the following change: 4.0 mass % of a dimethyl silicone oil having a viscosity at 25° C. of 70 $mm^2/s$ was added as a surface treatment agent to 100 parts by mass of the silica original body. Table 1 summarizes their number average particle diameter of primary particles, treatment agent, and physical property.

[Production Examples of Silica Fine Particles A3 to A7]

Silica fine particles A3 to A7 were produced by the same approach as that of the silica fine particles A1 except that the average particle diameter of the silica original body was changed. Table 1 summarizes their number average particle diameters of primary particles, treatment agents, and physical properties.

TABLE 1

| Silica fine particles A No. | Number-average particle diameter of primary particles (nm) | Treatment agent | Charge quantity QA (mC/kg) |
|---|---|---|---|
| Silica fine particles A1 | 120 | Hexamethyldisilazane | −110 (negatively chargeable) |
| Silica fine particles A2 | 120 | Silicone oil | −100 (negatively chargeable) |

TABLE 1-continued

| Silica fine particles A No. | Number-average particle diameter of primary particles (nm) | Treatment agent | Charge quantity QA (mC/kg) |
|---|---|---|---|
| Silica fine particles A3 | 120 | Untreated | −10 (negatively chargeable) |
| Silica fine particles A4 | 70 | Hexamethyldisilazane | −110 (negatively chargeable) |
| Silica fine particles A5 | 280 | Hexamethyldisilazane | −110 (negatively chargeable) |
| Silica fine particles A6 | 50 | Hexamethyldisilazane | −110 (negatively chargeable) |
| Silica fine particles A7 | 320 | Hexamethyldisilazane | −110 (negatively chargeable) |

[Production Example of Strontium Titanate Fine Particles B1]

A titanium hydroxide-containing slurry obtained by hydrolyzing an aqueous solution of titanyl sulfate was washed with an alkali aqueous solution. Next, hydrochloric acid was added to the titanium hydroxide-containing slurry to adjust its pH to 0.65. Thus, a titania sol dispersion was obtained. NaOH was added to the titania sol dispersion to adjust the pH of the dispersion to 4.5, and washing was repeated until the electric conductivity of the supernatant became 70 μS/cm. $Sr(OH)_2.8H_2O$ was added in a molar amount 0.97 times as large as that of the titanium hydroxide to the slurry, and the slurry was charged into a reaction vessel made of SUS, followed by the replacement of the inside of the vessel with a nitrogen gas. Further, distilled water was added to the slurry so as to achieve a concentration of 0.5 mol/l in terms of $SrTiO_3$. The temperature of the slurry was increased to 83° C. at 6.5° C./hr in a nitrogen atmosphere. After the temperature had reached 83° C., a reaction was performed for 6 hours. After the reaction, the slurry was cooled to room temperature and the supernatant was removed. After that, the remaining slurry was repeatedly washed with pure water. Further, under the nitrogen atmosphere, the slurry was charged into an aqueous solution having dissolved therein 6.5 mass % of sodium stearate (having 18 carbon atoms) with respect to the solid matter of the slurry, and an aqueous solution of zinc sulfate was dropped to the slurry while the slurry was stirred. Thus, zinc stearate was precipitated on a perovskite crystal surface. The slurry was repeatedly washed with pure water and then filtered with a Nutsche. The resultant cake was dried to provide strontium titanate fine particles whose surfaces had been treated with stearic acid. The surface-treated strontium titanate fine particles are defined as strontium titanate fine particles B1. Table 2 shows the physical property of the strontium titanate fine particles B1.

[Production Examples of Strontium Titanate Fine Particles B2 to B14]

Strontium titanate fine particles B2 to B14 were produced by the same approach as that of the strontium titanate fine particles B1 except that the number average particle diameter and treatment agent were changed. Table 2 summarizes the number average particle diameters of their primary particles, and their treatment agents and physical properties.

TABLE 2

| Strontium titanate fine particles B No. | Number-average particle diameter of primary particles (nm) | Shape | Surface-treating fatty acid (surface treatment agent) | (C number) | Charge quantity QB (mC/kg) |
|---|---|---|---|---|---|
| Strontium titanate fine particles B1 | 120 | Mixture of cube and rectangular parallelepiped | Stearic acid (sodium) | C18 | +54 (positively chargeable) |
| Strontium titanate fine particles B2 | 120 | Mixture of cube and rectangular parallelepiped | Myristic acid (sodium) | C14 | +48 (positively chargeable) |
| Strontium titanate fine particles B3 | 120 | Mixture of cube and rectangular parallelepiped | Pentadecylic acid (sodium) | C15 | +49 (positively chargeable) |
| Strontium titanate fine particles B4 | 120 | Mixture of cube and rectangular parallelepiped | Palmitic acid (sodium) | C16 | +51 (positively chargeable) |
| Strontium titanate fine particles B5 | 120 | Mixture of cube and rectangular parallelepiped | Margaric acid (sodium) | C17 | +52 (positively chargeable) |
| Strontium titanate fine particles B6 | 120 | Mixture of cube and rectangular parallelepiped | Tuberculostearic acid (sodium) | C19 | +52 (positively chargeable) |
| Strontium titanate fine particles B7 | 120 | Mixture of cube and rectangular parallelepiped | Arachidic acid (sodium) | C20 | +51 (positively chargeable) |
| Strontium titanate fine particles B8 | 120 | Mixture of cube and rectangular parallelepiped | Behenic acid (sodium) | C21 | +51 (positively chargeable) |
| Strontium titanate fine particles B9 | 120 | Mixture of cube and rectangular parallelepiped | Stearic acid (potassium) | C22 | +48 (positively chargeable) |
| Strontium titanate fine particles B10 | 40 | Mixture of cube and rectangular parallelepiped | Stearic acid (sodium) | C22 | +54 (positively chargeable) |
| Strontium titanate fine particles B11 | 280 | Mixture of cube and rectangular parallelepiped | Stearic acid (sodium) | C22 | +54 (positively chargeable) |
| Strontium titanate fine particles B12 | 25 | Mixture of cube and rectangular parallelepiped | Stearic acid (sodium) | C22 | +54 (positively chargeable) |
| Strontium titanate fine particles B13 | 320 | Mixture of cube and rectangular parallelepiped | Stearic acid (sodium) | C22 | +54 (positively chargeable) |
| Strontium titanate fine particles B14 | 120 | Mixture of cube and rectangular parallelepiped | Alkylsilane | | −117 (negatively chargeable) |

[Production Example of Magnetic Carrier 1]

<Production of Copolymer 1>

25 Parts by mass of a methyl methacrylate macromer (average n=50) having a weight-average molecular weight of 5,000, the macromer having a structure represented by the following formula (3) and having an ethylenically unsaturated group (methacryloyl group) at one terminal thereof, and 75 parts by mass of a cyclohexyl methacrylate monomer represented by the following formula (4) were loaded into a four-necked flask having a reflux condenser, a temperature gauge, a nitrogen suction pipe, and a grinding-type stirring apparatus. 90 Parts by mass of toluene, 110 parts by mass of methyl ethyl ketone, and 2.0 parts by mass of azobisisovaleronitrile were further loaded into the flask. The resultant mixture was held in a stream of nitrogen at 70° C. for 10 hours. After the completion of a polymerization reaction, washing was repeated to provide a graft copolymer solution (having a solid content of 33 mass %). The solution had a weight-average molecular weight determined by gel permeation chromatography (GPC) of 56,000. In addition, the solution had a Tg of 91° C. The solution is defined as a copolymer 1.

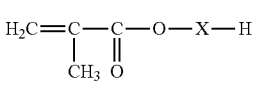

(3)

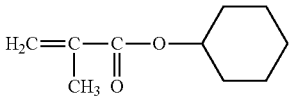

(4)

<Production of Carrier Core>

Step 1 (Weighing/Mixing Step):

| | |
|---|---|
| $Fe_2O_3$ | 60.2 mass % |
| $MnCO_3$ | 33.9 mass % |
| $Mg(OH)_2$ | 4.8 mass % |
| $SrCO_3$ | 1.1 mass % |

Ferrite raw materials were weighed so that the foregoing contents were obtained. After that, the raw materials were pulverized and mixed with a dry ball mill using zirconia balls (each having a diameter of 10 mm) for 2 hours.

Step 2 (Preliminary Calcination Step):

After the pulverization and mixing, the resultant was calcined with a burner-type furnace in the air at 1,000° C. for 3 hours to produce a preliminarily calcined ferrite. The composition of the ferrite is as described below.

$$(MnO)_a(MgO)_b(SrO)_c(Fe_2O_3)_d$$

In the formula, a=0.39, b=0.11, c=0.01, and d=0.50.

Step 3 (Pulverization Step):

The preliminarily calcined ferrite was pulverized into pieces each having a size of about 0.5 mm with a crusher. After that, 30 parts by mass of water were added to 100 parts by mass of the preliminarily calcined ferrite, and the mixture was pulverized with a wet ball mill using zirconia balls (each having a diameter of 10 mm) for 2 hours. The slurry was pulverized with a wet bead mill using zirconia beads (each having a diameter of 1.0 mm) for 4 hours to provide a ferrite slurry.

Step 4 (Granulation Step):

2.0 Parts by mass of polyvinyl alcohol with respect to 100 parts by mass of the preliminarily calcined ferrite were added as a binder to the ferrite slurry, and the mixture was granulated with a spray dryer (manufacturer: OHKAWARA KAKOHKI CO., LTD.) into spherical particles each having a diameter of about 36 μm.

Step 5 (Main Calcination Step):

In order for a calcination atmosphere to be controlled, the spherical particles were calcined in an electric furnace under a nitrogen atmosphere (having an oxygen concentration of 1.00 vol % or less) at 1,150° C. for 4 hours.

Step 6 (Screening Step):

After an agglomerated particle had been shredded, screening was performed with a screen having an aperture of 250 μm to remove coarse particles. Thus, magnetic core particles (carrier core particles) having a 50% particle diameter (D50) on a volume basis of 31 μm were obtained.

<Production of Magnetic Carrier 1>

The copolymer 1 was dissolved in toluene so as to have a solid content of 10 mass %. 5 Parts by mass of carbon black (#25 manufactured by Mitsubishi Chemical Corporation) with respect to 100 parts by mass of covering resin (i.e. copolymer 1) solid matter were added to the solution, and the mixture was sufficiently stirred and dispersed to provide a coating solution.

Next, the coating solution was charged in three portions by using a universal mixing-stirring machine (manufactured by Fuji Paudal Co., Ltd.) as a coating apparatus so that the amount of a covering resin (in terms of solid matter) became 1.5 parts by mass with respect to 100 parts by mass of the carrier core particles. At that time, the inside of the mixing machine was decompressed and nitrogen was introduced into the machine to establish a nitrogen atmosphere. A temperature was increased to 65° C., and the mixture was stirred in the nitrogen atmosphere while the decompressed state (700 MPa) was maintained, thereby removing the solvent until the carrier became smooth. While the stirring was further performed and nitrogen was introduced, the temperature was increased to 100° C. and held for 1 hour. After cooling, a magnetic carrier 1 was obtained. The magnetic carrier 1 had a 50% particle diameter (D50) on a volume basis of 34 μm.

[Production Example of Magnetic Carrier 2]

A mixed liquid of 1 part by mass of a silicone resin ("KR271," manufactured by Shin-Etsu Chemical Co., Ltd.), 0.5 part by mass of γ-aminopropyltriethoxysilane, and 98.5 parts by mass of toluene was added to 100 parts by mass of the carrier core particles, and the solvent was removed by drying the contents under reduced pressure at 75° C. for 5 hours while stirring and mixing the contents with a solution decompression kneader. After that, the remainder was subjected to baking treatment at 145° C. for 2 hours and sieved with a sieve shaker ("300 MM-2 Type," TSUTSUI SCIENTIFIC INSTRUMENTS CO., LTD.: 75-μm aperture) to provide a magnetic carrier 2. The magnetic carrier 2 had a 50% particle diameter (D50) on a volume basis of 34 μm.

[Production Example of Toner 1]

| | |
|---|---|
| Binder resin 1 | 50 parts by mass |
| Binder resin 2 | 50 parts by mass |
| Fischer-Tropsch wax (peak temperature of the highest endothermic peak: 78° C.) | 5 parts by mass |
| C.I. Pigment Blue 15:3 | 5 parts by mass |
| Aluminum 3,5-di-t-butylsalicylate compound | 0.5 part by mass |

Raw materials shown in the formulation were mixed with a Henschel mixer (FM-75 Type manufactured by Mitsui Mining CO., LTD.) at a number of rotations of 20 $s^{-1}$ for a time of rotation of 5 min. After that, the mixture was kneaded with a twin-screw kneader (PCM-30 Type manufactured by Ikegai Corp.) set at a temperature of 125° C. The resultant kneaded product was cooled and coarsely pulverized with a hammer mill to 1 mm or less to provide a coarsely pulverized product. The resultant coarsely pulverized product was finely pulverized with a mechanical pulverizer (T-250 manufactured by Turbo Kogyo Co., Ltd.). Further, the resultant was classified with a rotary classifier (200TSP manufactured by Hosokawa Micron Corporation) to provide toner particles. The rotary classifier (200TSP manufactured by Hosokawa Micron Corporation) was operated under the following condition: the classification was performed at a number of rotations of a classification rotor of 50.0 $s^{-1}$. The resultant toner particles had a weight-average particle diameter (D4) of 5.7 μm.

5.0 Parts by mass of the silica fine particles A1 were added to 100 parts by mass of the resultant toner particles, and the particles were mixed with a Henschel mixer (FM-75 Type manufactured by Mitsui Mining CO., LTD.) at a number of rotations of 30 $s^{-1}$ for a time of rotation of 10 min, followed by thermal spheroidizing treatment with the surface treatment apparatus illustrated in FIG. 1. The apparatus was operated under the conditions of a feeding amount of 5 kg/hr, a hot air temperature C of 240° C., a hot air flow rate of 6 $m^3$/min, a cold air temperature E of 5° C., a cold air flow rate of 4 $m^3$/min, a cold air absolute moisture content of 3 g/$m^3$, a blower air quantity of 20 $m^3$/min, and an injection air flow rate of 1 $m^3$/min. The resultant treated toner particles had an average circularity of 0.963 and a weight-average particle diameter (D4) of 6.2 μm.

0.5 Part by mass of the strontium titanate fine particles B1 was added to 100 parts by mass of the resultant treated toner particles, and the particles were mixed with a Henschel mixer (FM-75 Type manufactured by Mitsui Miike Chemical Engineering Machinery CO., LTD.) at a number of rotations of 30 $s^{-1}$ for a time of rotation of 10 min to provide a toner 1. Table 3 shows the outline of the toner 1 and Table 4 shows its physical properties.

[Production Examples of Toners 2 to 18]

Toners 2 to 18 were produced in the same manner as in the production example of the toner 1 except that the silica fine particles A and the strontium titanate fine particles B, and their addition numbers of parts were changed as shown in Table 3. Table 3 shows the outlines of the toners 2 to 18 and Table 4 shows their physical properties.

[Production Example of Toner 19]

A toner 19 was produced in the same manner as in the production example of the toner 1 except that the silica fine particles A and the strontium titanate fine particles B, and their addition numbers of parts were changed as shown in Table 3 and the time of rotation of the Henschel mixer at the time of the external addition of the strontium titanate fine particles B was changed to 30 min. Table 3 shows the outline of the toner 19 and Table 4 shows its physical properties.

[Production Examples of Toners 20 to 25]

Toners 20 to 25 were produced in the same manner as in the production example of the toner 1 except that the silica fine particles A and the strontium titanate fine particles B, and their addition numbers of parts were changed as shown in Table 3. Table 3 shows the outlines of the toners 20 to 25 and Table 4 shows their physical properties.

[Production Example of Toner 26]

A toner 26 was produced in the same manner as in the production example of the toner 1 except that no thermal spheroidizing treatment was performed. Table 3 shows the outline of the toner 26 and Table 4 shows its physical properties.

[Production Examples of Toners 27 to 31]

Toners 27 to 31 were produced in the same manner as in the production example of the toner 1 except that the silica fine particles A and the strontium titanate fine particles B, and their addition numbers of parts were changed as shown in Table 3. Table 3 shows the outlines of the toners 27 to 31 and Table 4 shows their physical properties.

TABLE 3

| Toner No. | Silica fine particles A No. | Addition number of parts of silica fine particles A (part(s)) | Fixing treatment | Strontium titanate fine particles B No. | Addition number of parts of strontium titanate fine particles B (part(s)) |
|---|---|---|---|---|---|
| Toner 1 | Silica fine particles A1 | 5.0 | Thermal fixing | Strontium titanate fine particles B1 | 0.5 |
| Toner 2 | Silica fine particles A1 | 5.0 | Thermal fixing | Strontium titanate fine particles B10 | 0.5 |
| Toner 3 | Silica fine particles A1 | 5.0 | Thermal fixing | Strontium titanate fine particles B11 | 0.5 |
| Toner 4 | Silica fine particles A1 | 5.0 | Thermal fixing | Strontium titanate fine particles B12 | 0.5 |
| Toner 5 | Silica fine particles A1 | 5.0 | Thermal fixing | Strontium titanate fine particles B13 | 0.5 |
| Toner 6 | Silica fine particles A1 | 5.0 | Thermal fixing | Strontium titanate fine particles B1 | 0.3 |
| Toner 7 | Silica fine particles A1 | 5.0 | Thermal fixing | Strontium titanate fine particles B1 | 3.8 |
| Toner 8 | Silica fine particles A1 | 5.0 | Thermal fixing | Strontium titanate fine particles B1 | 0.1 |
| Toner 9 | Silica fine particles A1 | 5.0 | Thermal fixing | Strontium titanate fine particles B1 | 4.5 |
| Toner 10 | Silica fine particles A2 | 5.0 | Thermal fixing | Strontium titanate fine particles B1 | 0.5 |
| Toner 11 | Silica fine particles A2 | 5.0 | Thermal fixing | Strontium titanate fine particles B2 | 0.5 |
| Toner 12 | Silica fine particles A2 | 5.0 | Thermal fixing | Strontium titanate fine particles B3 | 0.5 |
| Toner 13 | Silica fine particles A2 | 5.0 | Thermal fixing | Strontium titanate fine particles B4 | 0.5 |
| Toner 14 | Silica fine particles A2 | 5.0 | Thermal fixing | Strontium titanate fine particles B5 | 0.5 |
| Toner 15 | Silica fine particles A2 | 5.0 | Thermal fixing | Strontium titanate fine particles B6 | 0.5 |
| Toner 16 | Silica fine particles A2 | 5.0 | Thermal fixing | Strontium titanate fine particles B7 | 0.5 |
| Toner 17 | Silica fine particles A2 | 5.0 | Thermal fixing | Strontium titanate fine particles B8 | 0.5 |
| Toner 18 | Silica fine particles A2 | 5.0 | Thermal fixing | Strontium titanate fine particles B9 | 0.5 |
| Toner 19 | Silica fine particles A2 | 5.0 | Mechanical fixing | Strontium titanate fine particles B1 | 0.5 |
| Toner 20 | Silica fine particles A2 | 2.2 | Thermal fixing | Strontium titanate fine particles B1 | 0.5 |
| Toner 21 | Silica fine particles A2 | 8.0 | Thermal fixing | Strontium titanate fine particles B1 | 0.5 |
| Toner 22 | Silica fine particles A4 | 5.0 | Thermal fixing | Strontium titanate fine particles B1 | 0.5 |
| Toner 23 | Silica fine particles A5 | 5.0 | Thermal fixing | Strontium titanate fine particles B1 | 0.5 |
| Toner 24 | Silica fine particles A3 | 5.0 | Thermal fixing | Strontium titanate fine particles B1 | 0.5 |
| Toner 25 | Silica fine particles A3 | 5.0 | Thermal fixing | Strontium titanate fine particles B14 | 0.5 |
| Toner 26 | Silica fine particles A3 | 5.0 | No fixing step | Strontium titanate fine particles B14 | 0.5 |

TABLE 3-continued

| Toner No. | Silica fine particles A No. | Addition number of parts of silica fine particles A (part(s)) | Fixing treatment | Strontium titanate fine particles B No. | Addition number of parts of strontium titanate fine particles B (part(s)) |
|---|---|---|---|---|---|
| Toner 27 | Silica fine particles A3 | 1.0 | Thermal fixing | Strontium titanate fine particles B14 | 0.5 |
| Toner 28 | Silica fine particles A3 | 12.0 | Thermal fixing | Strontium titanate fine particles B14 | 0.5 |
| Toner 29 | Silica fine particles A6 | 5.0 | Thermal fixing | Strontium titanate fine particles B14 | 0.5 |
| Toner 30 | Silica fine particles A7 | 5.0 | Thermal fixing | Strontium titanate fine particles B14 | 0.5 |
| Toner 31 | Silica fine particles A1 | 5.0 | Thermal fixing | None | None |

TABLE 4

| Toner No. | Number-average particle diameter of silica fine particles A calculated by observing the surface of the toner (nm) | Number-average particle diameter of strontium titanate fine particles B calculated by observing the surface of the toner (nm) | Fixing rate of strontium titanate fine particles B | Coverage rate (X) of silica fine particles A | Coverage rate (Y/X) of silica fine particles A |
|---|---|---|---|---|---|
| Toner 1 | 120 | 120 | 0.25 | 50.0 | 0.85 |
| Toner 2 | 120 | 40 | 0.45 | 50.0 | 0.85 |
| Toner 3 | 120 | 280 | 0.15 | 50.0 | 0.85 |
| Toner 4 | 120 | 25 | 0.70 | 50.0 | 0.85 |
| Toner 5 | 120 | 320 | 0.05 | 50.0 | 0.85 |
| Toner 6 | 120 | 120 | 0.45 | 50.0 | 0.85 |
| Toner 7 | 120 | 120 | 0.15 | 50.0 | 0.85 |
| Toner 8 | 120 | 120 | 0.70 | 50.0 | 0.85 |
| Toner 9 | 120 | 120 | 0.05 | 50.0 | 0.85 |
| Toner 10 | 120 | 120 | 0.25 | 50.0 | 0.85 |
| Toner 11 | 120 | 120 | 0.25 | 50.0 | 0.85 |
| Toner 12 | 120 | 120 | 0.25 | 50.0 | 0.85 |
| Toner 13 | 120 | 120 | 0.25 | 50.0 | 0.85 |
| Toner 14 | 120 | 120 | 0.25 | 50.0 | 0.85 |
| Toner 15 | 120 | 120 | 0.25 | 50.0 | 0.85 |
| Toner 16 | 120 | 120 | 0.25 | 50.0 | 0.85 |
| Toner 17 | 120 | 120 | 0.25 | 50.0 | 0.85 |
| Toner 18 | 120 | 120 | 0.25 | 50.0 | 0.85 |
| Toner 19 | 120 | 120 | 0.25 | 50.0 | 0.78 |
| Toner 20 | 120 | 120 | 0.25 | 22.0 | 0.85 |
| Toner 21 | 120 | 120 | 0.25 | 80.0 | 0.85 |
| Toner 22 | 70 | 120 | 0.25 | 22.0 | 0.90 |
| Toner 23 | 280 | 120 | 0.25 | 30.0 | 0.78 |
| Toner 24 | 120 | 120 | 0.25 | 30.0 | 0.85 |
| Toner 25 | 120 | 120 | 0.25 | 30.0 | 0.85 |
| Toner 26 | 120 | 120 | 0.80 | 50.0 | 0.30 |
| Toner 27 | 120 | 120 | 0.80 | 15.0 | 0.85 |
| Toner 28 | 120 | 120 | 0.80 | 95.0 | 0.85 |
| Toner 29 | 50 | 120 | 0.80 | 15.0 | 0.95 |
| Toner 30 | 320 | 120 | 0.80 | 18.0 | 0.60 |
| Toner 31 | 120 | — | — | 50.0 | 0.85 |

Example 1

The toner 1 and the magnetic carrier 1 were mixed with a V-type mixer (V-10 Type: TOKUJU CORPORATION) at 0.5 $s^{-1}$ for a time of rotation of 5 min so as to have a toner concentration of 9 mass %. Thus, a two-component developer 1 was obtained.

Evaluations were performed by using the two-component developer 1.

(Evaluation 1)

A reconstructed machine of a full-color copying machine image RUNNER ADVANCE C5255 manufactured by Canon Inc. was used as an image-forming apparatus. An image output evaluation (A4 horizontal, 80% print percentage, 1,000-sheet continuous feeding) was performed under an environment having a temperature of 32.5° C. and a humidity of 80% RH (hereinafter described as "H/H"). A Cy station was used as a station.

During a 1,000-sheet continuous feeding time, sheet feeding is performed under the same development condition and transfer condition (no calibration) as those of a first sheet. Copier paper CS-814 (A4, basis weight: 81.4 (g/$m^2$), available from Canon Marketing Japan Inc.) was used as evaluation paper. In the evaluation environment, such adjustment that the laid-on level of the toner of an FFH image (solid portion) on the paper became 0.4 mg/$cm^2$ was performed. The FFH image is a value obtained by representing 256 gray levels in a hexadecimal notation, OOH is defined as a first gray level (white portion), and FFH is defined as a 256-th gray level (solid portion).

The image densities (FFH image portions; solid portions) of an initial stage (the first sheet) and a 1,000-th sheet were measured with an X-Rite color reflection densitometer (500 series: manufactured by X-Rite), and the evaluation was performed based on a difference between the image densities by the following criteria.

(Evaluation Criteria)

A: Less than 0.05

B: 0.05 or more and less than 0.10

C: 0.10 or more and less than 0.20

D: 0.20 or more (Evaluation 2)

An evaluation was performed in the same manner as in the evaluation 1 except that the evaluation environment was changed to an environment having a temperature of 23° C. and a humidity of 50% RH (hereinafter described as "N/N").

(Evaluation 3)

In the N/N environment, a printout was performed by using plain paper for a color copying machine or printer "CS-814 (A4, 81.4 g/$m^2$)" (available from Canon Marketing Japan Inc.) as evaluation paper. Used as a pattern image to be output was a pattern image 1 in which a belt-shaped solid portion having a width of 2 mm and a belt-shaped white portion having a width of 18 mm were repeatedly placed in a direction parallel to the direction in which the paper was fed. At this time, the laid-on level of the toner in the solid portion in the pattern image 1 on the paper was set to 0.40 mg/$cm^2$. After the pattern image 1 had been output on 100,000 sheets, such a pattern image 2 that the entire surface on the paper was the solid portion was output (the laid-on level of the toner in the solid portion on the paper was 0.40 mg/$cm^2$).

Image densities at 20 sites selected at random from the pattern image 2 were measured with an X-Rite color reflection densitometer ("500 series," manufactured by X-Rite). A difference between the maximum and minimum of the image densities at the 20 sites (image density difference) was calculated, and an evaluation was performed by using the value based on the following criteria. It should be noted that the evaluation is an evaluation for the extent to which a charging roller is contaminated at the time point when the image is output on 100,000 sheets. Table 6 shows the results.

(Evaluation Criteria)

A: The image density difference is less than 0.03.

B: The image density difference is 0.03 or more and less than 0.05.

C: The image density difference is 0.05 or more and less than 0.10.

D: The image density difference is 0.10 or more.

Examples 2 to 25

Two-component developers were obtained in the same manner as in Example 1 except that the combination of the toner and the carrier was changed as shown in Table 5. The developers were evaluated in the same manner as in Example 1. Table 6 shows the results.

Comparative Examples 1 to 9

Two-component developers were obtained in the same manner as in Example 1 except that the combination of the toner and the carrier was changed as shown in Table 5. The developers were evaluated in the same manner as in Example 1. Table 6 shows the results.

TABLE 5

| Example No. | Toner No. | Magnetic carrier No. | Developer No. |
|---|---|---|---|
| Example 1 | Toner 1 | Magnetic carrier 1 | Developer 1 |
| Example 2 | Toner 1 | Magnetic carrier 2 | Developer 2 |
| Example 3 | Toner 2 | Magnetic carrier 1 | Developer 3 |
| Example 4 | Toner 3 | Magnetic carrier 1 | Developer 4 |
| Example 5 | Toner 4 | Magnetic carrier 1 | Developer 5 |
| Example 6 | Toner 5 | Magnetic carrier 1 | Developer 6 |
| Example 7 | Toner 6 | Magnetic carrier 1 | Developer 7 |
| Example 8 | Toner 7 | Magnetic carrier 1 | Developer 8 |
| Example 9 | Toner 8 | Magnetic carrier 1 | Developer 9 |
| Example 10 | Toner 9 | Magnetic carrier 1 | Developer 10 |
| Example 11 | Toner 10 | Magnetic carrier 1 | Developer 11 |
| Example 12 | Toner 11 | Magnetic carrier 1 | Developer 12 |
| Example 13 | Toner 12 | Magnetic carrier 1 | Developer 13 |
| Example 14 | Toner 13 | Magnetic carrier 1 | Developer 14 |
| Example 15 | Toner 14 | Magnetic carrier 1 | Developer 15 |
| Example 16 | Toner 15 | Magnetic carrier 1 | Developer 16 |
| Example 17 | Toner 16 | Magnetic carrier 1 | Developer 17 |
| Example 18 | Toner 17 | Magnetic carrier 1 | Developer 18 |
| Example 19 | Toner 18 | Magnetic carrier 1 | Developer 19 |
| Example 20 | Toner 19 | Magnetic carrier 1 | Developer 20 |
| Example 21 | Toner 20 | Magnetic carrier 1 | Developer 21 |
| Example 22 | Toner 21 | Magnetic carrier 1 | Developer 22 |
| Example 23 | Toner 22 | Magnetic carrier 1 | Developer 23 |
| Example 24 | Toner 23 | Magnetic carrier 1 | Developer 24 |
| Comparative Example 1 | Toner 24 | Magnetic carrier 1 | Developer 25 |
| Comparative Example 2 | Toner 25 | Magnetic carrier 1 | Developer 26 |
| Comparative Example 3 | Toner 26 | Magnetic carrier 1 | Developer 27 |
| Comparative Example 4 | Toner 27 | Magnetic carrier 1 | Developer 28 |
| Comparative Example 5 | Toner 28 | Magnetic carrier 1 | Developer 29 |
| Comparative Example 6 | Toner 29 | Magnetic carrier 1 | Developer 30 |
| Comparative Example 7 | Toner 30 | Magnetic carrier 1 | Developer 31 |
| Comparative Example 8 | Toner 31 | Magnetic carrier 1 | Developer 32 |

TABLE 6

| Example | Evaluation 1 | | Evaluation 2 | | Evaluation 3 | |
|---|---|---|---|---|---|---|
| Example 1 | A | 0.02 | A | 0.01 | A | 0.01 |
| Example 2 | B | 0.05 | A | 0.03 | A | 0.01 |
| Example 3 | B | 0.05 | A | 0.03 | A | 0.01 |
| Example 4 | B | 0.05 | A | 0.3 | A | 0.02 |
| Example 5 | B | 0.08 | B | 0.05 | A | 0.01 |
| Example 6 | B | 0.08 | B | 0.05 | B | 0.04 |
| Example 7 | B | 0.05 | A | 0.03 | A | 0.02 |
| Example 8 | B | 0.05 | A | 0.03 | A | 0.02 |
| Example 9 | B | 0.08 | B | 0.05 | A | 0.02 |
| Example 10 | B | 0.08 | B | 0.05 | B | 0.04 |
| Example 11 | B | 0.06 | A | 0.03 | A | 0.02 |
| Example 12 | B | 0.05 | A | 0.03 | A | 0.02 |
| Example 13 | B | 0.05 | A | 0.03 | A | 0.02 |
| Example 14 | B | 0.05 | A | 0.03 | A | 0.02 |
| Example 15 | B | 0.05 | A | 0.03 | A | 0.02 |
| Example 16 | B | 0.05 | A | 0.03 | A | 0.02 |
| Example 17 | B | 0.05 | A | 0.03 | A | 0.02 |
| Example 18 | B | 0.05 | A | 0.03 | A | 0.02 |
| Example 19 | B | 0.05 | A | 0.03 | A | 0.02 |
| Example 20 | B | 0.07 | B | 0.05 | A | 0.02 |
| Example 21 | B | 0.08 | B | 0.06 | A | 0.02 |
| Example 22 | A | 0.04 | A | 0.02 | C | 0.06 |
| Example 23 | C | 0.15 | B | 0.08 | A | 0.02 |
| Example 24 | C | 0.15 | B | 0.08 | A | 0.02 |
| Comparative Example 1 | D | 0.23 | C | 0.11 | A | 0.02 |
| Comparative Example 2 | D | 0.22 | C | 0.11 | A | 0.02 |
| Comparative Example 3 | D | 0.2 | C | 0.15 | A | 0.02 |
| Comparative Example 4 | D | 0.23 | C | 0.16 | A | 0.02 |
| Comparative Example 5 | A | 0.02 | A | 0.03 | D | 0.08 |
| Comparative Example 6 | D | 0.23 | C | 0.16 | A | 0.02 |
| Comparative Example 7 | D | 0.25 | C | 0.17 | A | 0.02 |
| Comparative Example 8 | D | 0.26 | C | 0.19 | A | 0.02 |

The silica fine particles whose surfaces have not been treated are used in Comparative Example 1. Probably because of the foregoing, the fine particles could not satisfy a relationship of charging with the strontium titanate fine particles and hence the effects of the present invention were not obtained.

The strontium titanate fine particles treated with the alkylsilane are used in Comparative Example 2. Probably because of the foregoing, the fine particles could not satisfy a relationship of charging with the silica fine particles and hence the effects of the present invention were not obtained.

The toner obtained without the step of fixing the silica fine particles A is used in Comparative Example 3. In the toner, both the coverage rate X and coverage rate (X/Y) of the silica fine particles A are low. Probably because of the foregoing, the effect of peeling charging by the strontium titanate fine particles B at the time of development was not obtained and the charge quantity of the toner did not increase, and as a result, a bad result was obtained for the density fluctuation.

The toner having a small number of parts of the silica and hence reduced in coverage rate is used in Comparative Example 4. Probably because of the foregoing, the effect of the peeling charging by the strontium titanate fine particles B at the time of the development was not obtained and the charge quantity of the toner did not increase, and as a result, a bad result was obtained for the density fluctuation.

The toner having an excessively large number of parts of the silica is used in Comparative Example 5. In the toner, a large excess amount of the silica is added and hence the amount of a free silica increases. Probably because of the foregoing, the contamination of the charging member occurred and hence the result of the evaluation for the contamination of the charging roller deteriorated.

The toner reduced in coverage rate because the silica has a small particle diameter and is hence embedded by the heat treatment is used in Comparative Example 6. Probably because of the foregoing, the effect of the peeling charging by the strontium titanate fine particles B at the time of the development was not obtained and the charge quantity of the toner did not increase, and as a result, a bad result was obtained for the density fluctuation.

The toner reduced in coverage rate because the silica has a large particle diameter is used in Comparative Example 7. Probably because of the foregoing, the effect of the peeling charging by the strontium titanate fine particles B at the time of the development was not obtained and the charge quantity of the toner did not increase, and as a result, a bad result was obtained for the density fluctuation.

In Comparative Example 8, the evaluations are performed by using the toner to which no strontium titanate fine particles have been added. In the toner, the effect of the peeling charging is not obtained. Probably because of the foregoing, the charge quantity of the toner did not increase, and as a result, a bad result was obtained for the density fluctuation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-195028, filed Sep. 20, 2013, which is hereby incorporated by reference herein in its entirety.

What is claimed is:

1. An image forming method comprising a step of developing with a developer containing a toner, the toner comprising:

toner particles each of which contains a binder resin, a wax, and a coloring agent;

negatively chargeable silica fine particles A on surfaces of the toner particles, the silica fine particles A having a number-average particle diameter (D1) of 60 to 300 nm, and an amount of the silica fine particles A is 2.0 parts by mass or more and 10.0 parts by mass or less when an amount of the toner particles is set to 100 parts by mass, positively chargeable strontium titanate fine particles B adhering to the silica fine particles A electrostatically, the strontium titanate fine particles B have a fixing rate of 0.10 to 0.60, and an amount of the strontium titanate fine particles B is 0.2 part by mass or more and 1.0 part by mass or less when an amount of the toner particles is set to 100 parts by mass, wherein Y/X is 0.75 or more, where a coverage rate of the surfaces of the toner particles with the silica fine particles A is X (%), X being 20 to 95%, and a coverage rate with the silica fine particles A fixed to the surfaces of the toner particles is Y (%), the step of developing includes a step of peeling the silica fine particles A and the strontium titanate fine particles B to increase a charge quantity of the toner.

2. The image forming method according to claim 1, wherein surfaces of the silica fine particles A are treated with one of hexamethyldisilazane and a silicone oil, and surfaces of the strontium titanate fine particles B are treated with one of a fatty acid and a fatty acid metal salt.

3. The image forming method according to claim 1, wherein primary particles of the strontium titanate fine particles B have a number-average particle diameter of 30 to 300 nm, and the strontium titanate fine particles B each have a perovskite crystal, and particle shapes of the strontium titanate fine particles B each have one of a cubic shape, a rectangular parallelepiped shape, and a mixture thereof.

4. The image forming method according to claim 1, wherein the silica fine particles A have a number-average particle diameter (D1) of 70 to 280 nm.

5. The image forming method according to claim 1, wherein the developer is a two-component developer comprising the toner and a magnetic carrier.

6. The image forming method according to claim 5, wherein the magnetic carrier has a carrier core, a surface of the carrier core is covered with a copolymer, and the copolymer contains, as copolymerization components:

a monomer having a structure represented by the following formula (1):

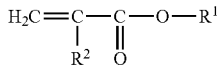

(1)

R1 represents a hydrocarbon group having 4 or more carbon atoms, and

R2 represents H or CH3; and a macromonomer having a structure represented by the following formula (2):

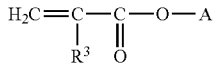

(2)

R3 represents H or CH3, and

A represents:

an alicyclic hydrocarbon group having 5 or more and 10 or less carbon atoms, or a polymer using, as a polymerization component, at least one kind of compound selected from the group consisting of methyl acrylate, methyl methacrylate, butyl acrylate, butyl methacrylate, 2-ethylhexyl acrylate, 2-ethylhexyl methacrylate, styrene, and acrylonitrile.

* * * * *